US006301939B1

(12) United States Patent
Kimmich et al.

(10) Patent No.: US 6,301,939 B1
(45) Date of Patent: Oct. 16, 2001

(54) METHOD OF PRODUCING A KNITTED ARTICLE ON A FLAT KNITTING MACHINE

(75) Inventors: Ulrich Kimmich, Pliezhausen; Henning Schmid; Oliver Vogt, both of Reutlingen, all of (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/148,595

(22) Filed: Sep. 4, 1998

(Under 37 CFR 1.47)

(30) Foreign Application Priority Data

Sep. 6, 1997 (DE) ..... 197 39 135

(51) Int. Cl.[7] ..... D04B 1/22
(52) U.S. Cl. ..... 66/170; 66/64
(58) Field of Search ..... 66/60 R, 169 R, 66/170, 171, 172 R, 176, 174, 190, 64, 175, 173; 24/90.1, 92, 114.12

(56) References Cited

U.S. PATENT DOCUMENTS 325,525 * 9/1885 Frankel ..... 66/174
528,536 * 11/1894 Sokoloff ..... 66/0
1,160,542 * 11/1915 Soon ..... 66/170
1,185,933 * 6/1916 Powell ..... 66/173
2,097,677 * 11/1937 Sokoloff ..... 66/170
2,190,030 * 2/1940 Kops ..... 66/170
2,393,268 * 1/1946 Rotkel ..... 66/170
2,858,685 * 11/1958 Sommers ..... 66/174
5,259,209 * 11/1993 Mitsumoto et al. ..... 66/173
5,890,381 * 4/1999 Leeke et al. ..... 66/173
5,992,185 * 11/1999 Leeke et al. ..... 66/173

* cited by examiner

*Primary Examiner*—Danny Worrell
(74) *Attorney, Agent, or Firm*—Michael J. Striker

(57) ABSTRACT

A knitting article is produced on a flat knitting machine with at least two needle beds by providing a knitted article with at least one button-shaped knitted stitch structure as a fastener, and converting the structure into several successive rows by knitting with a local stitch aggregation. Also, the stitch structure can be produced by a wedge forming technique with subsequent closing with a knitted-in knot thread. Also, the stitch structure can be formed by knitting with a small knitting strip connected at both ends with the knitted article.

10 Claims, 12 Drawing Sheets

FIG.5b
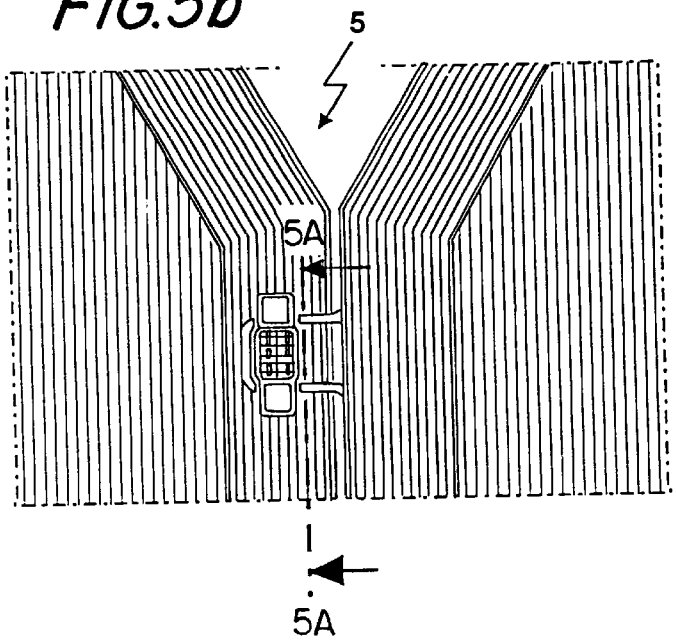
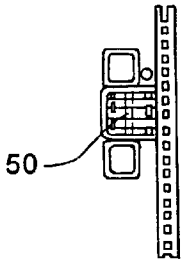
FIG.5a
FIG.5c
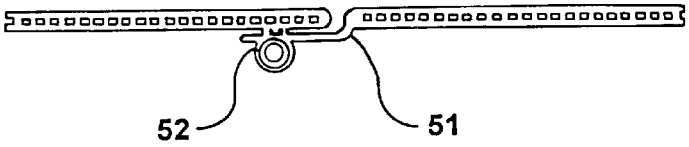

FIG.6.1A
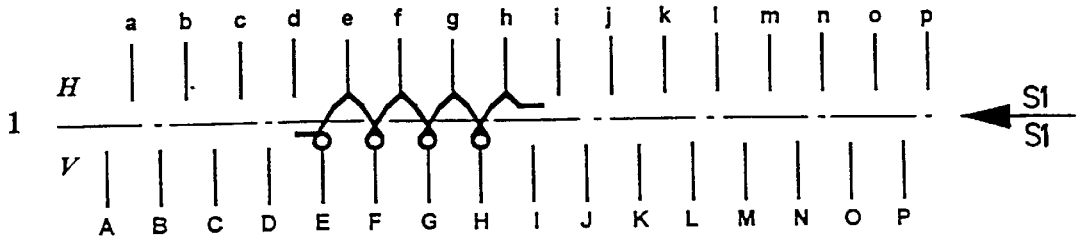
FIG.6.1B
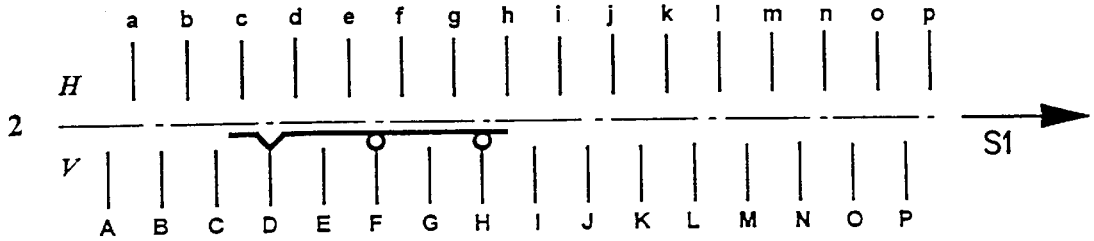
FIG.6.1C
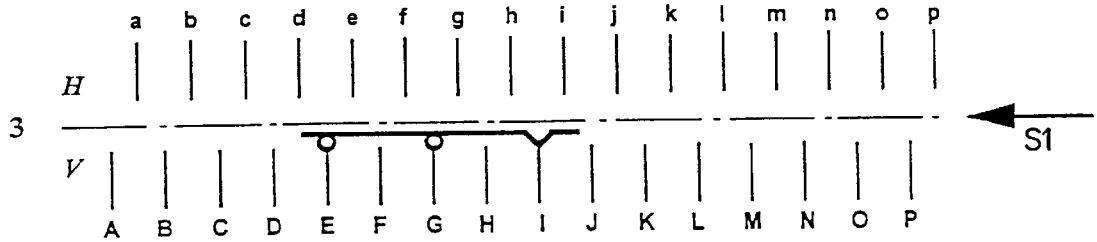
FIG.6.1D
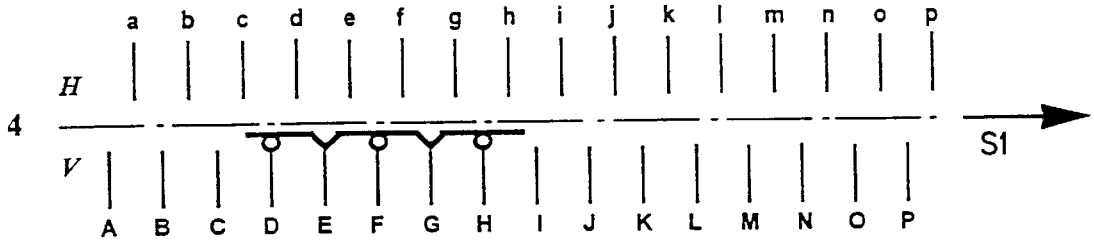
FIG.6.1E
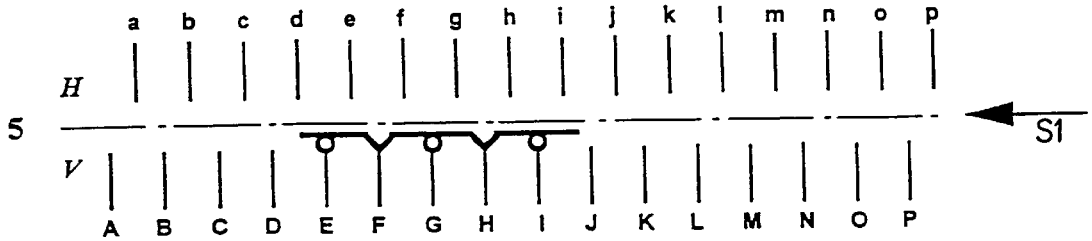

FIG.6.2A
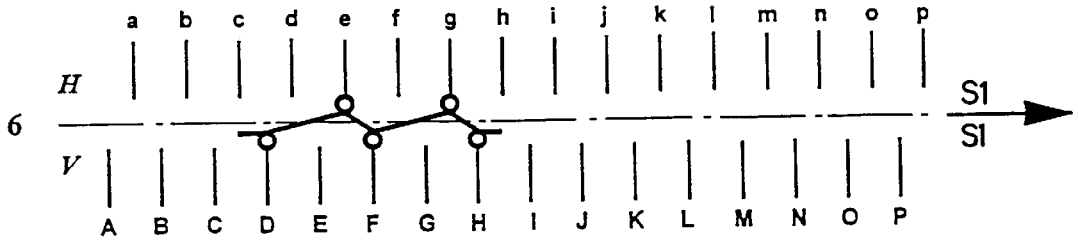
FIG.6.2B
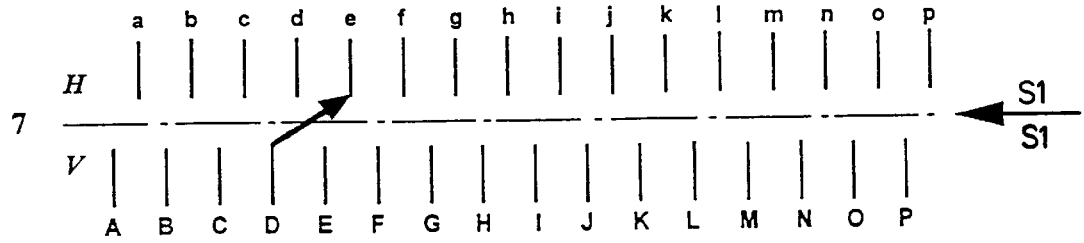
FIG.6.2C
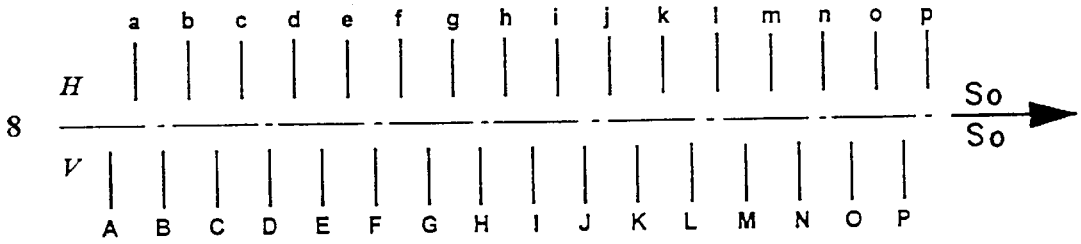
FIG.6.2D
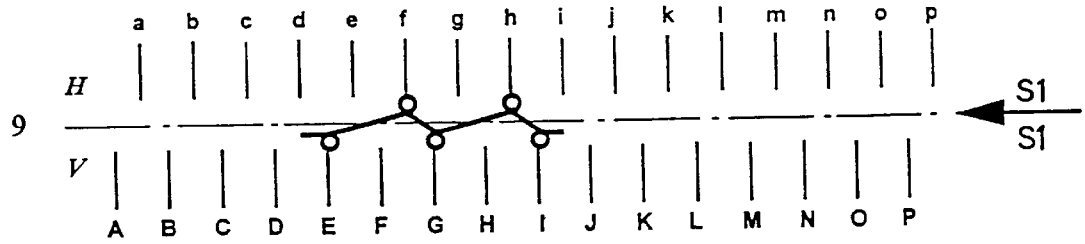
FIG.6.2E
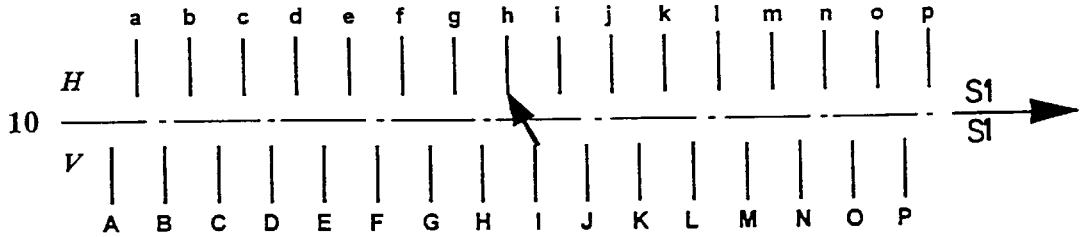

FIG.6.3A
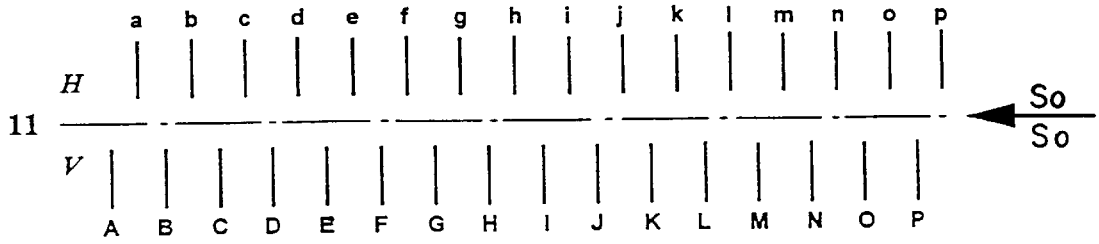
FIG.6.3B
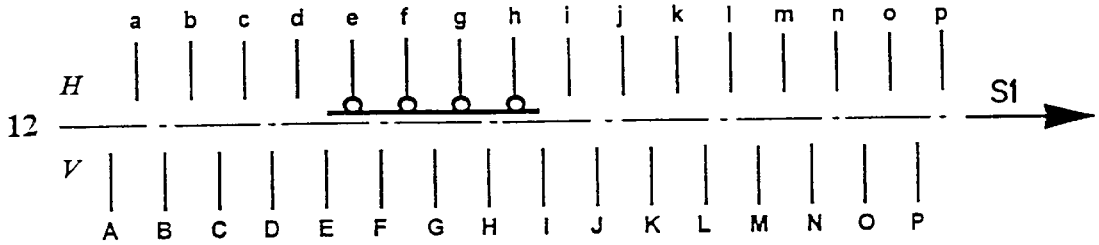

FIG.8.1A
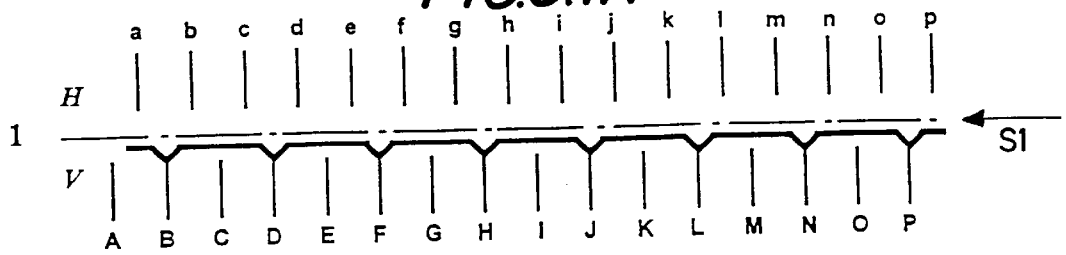
FIG.8.1B
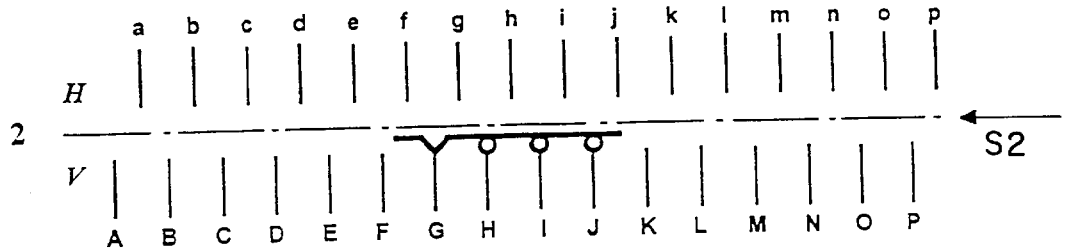
FIG.8.1C
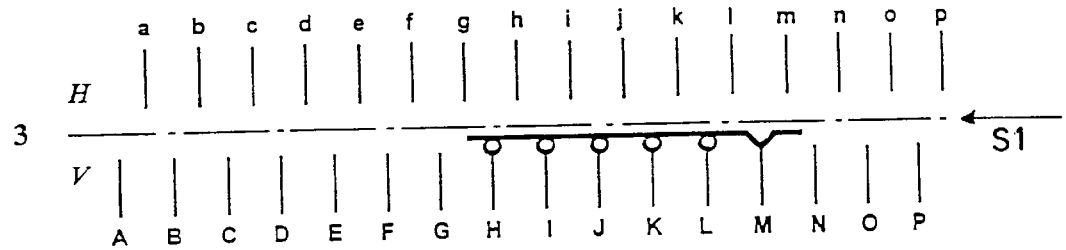
FIG.8.1D
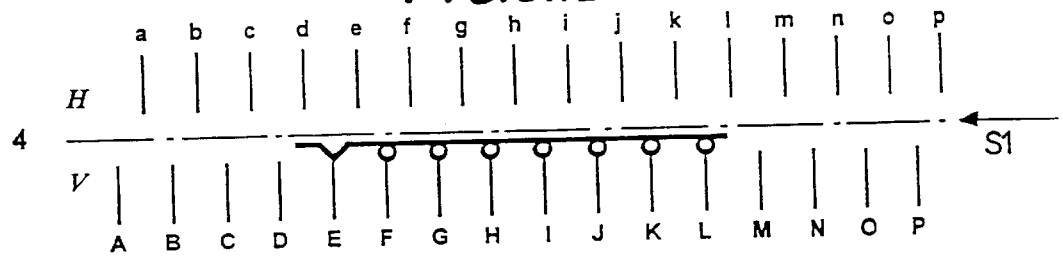
FIG.8.1E
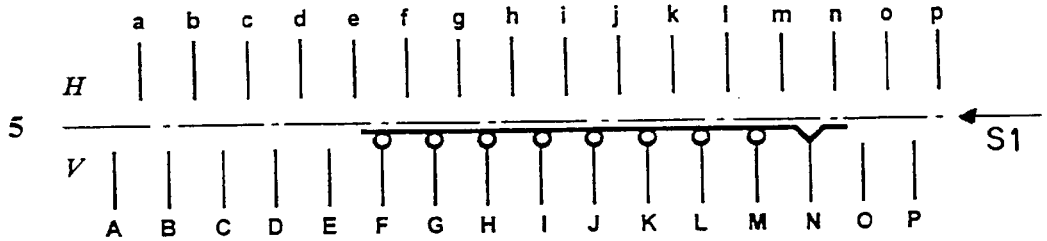

FIG.8.2A
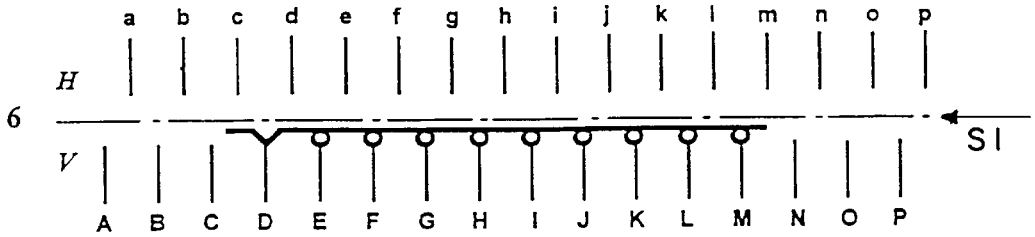
FIG.8.2B
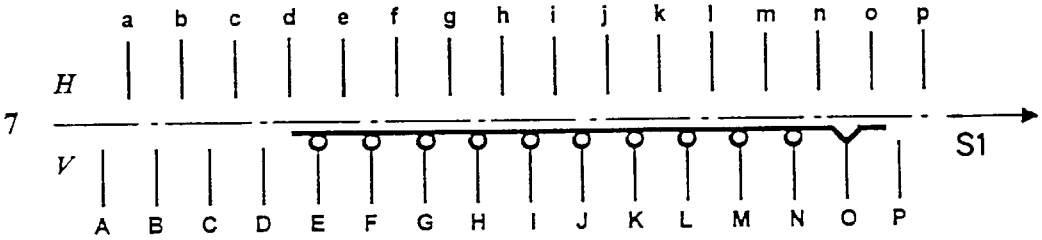
FIG.8.2C
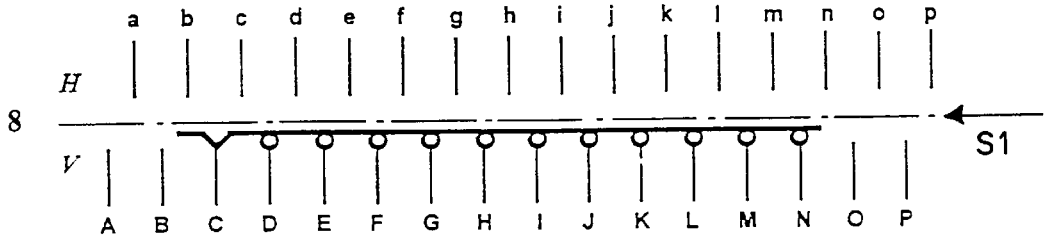
FIG.8.2D
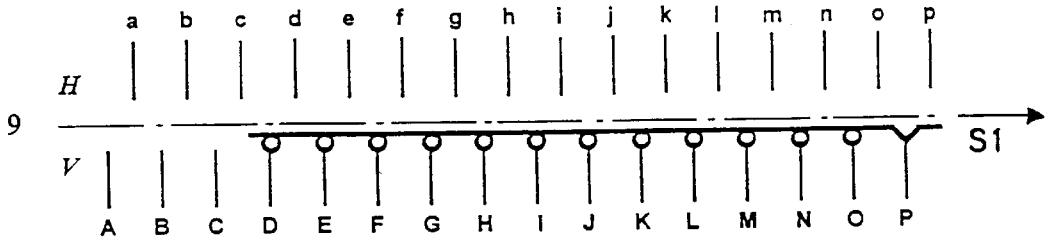
FIG.8.2E
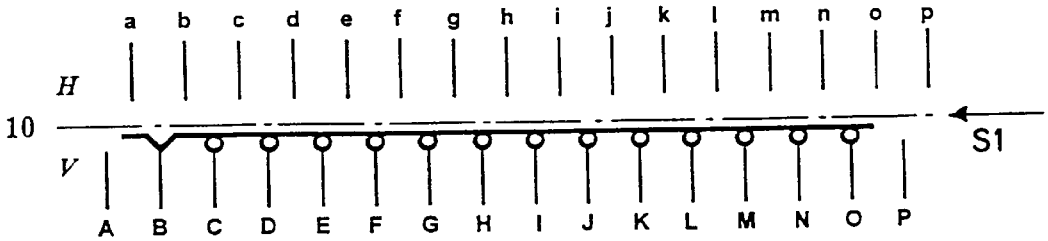

FIG.8.3A
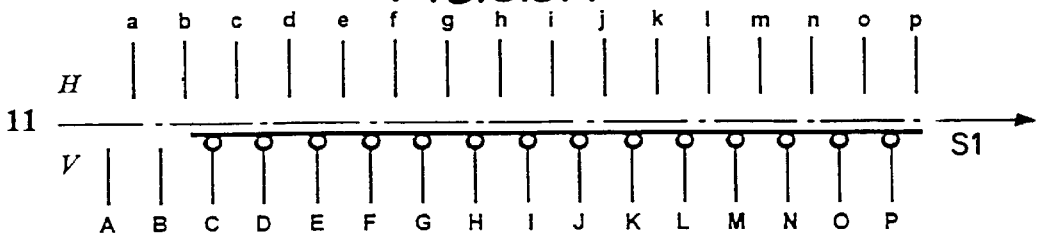
FIG.8.3B
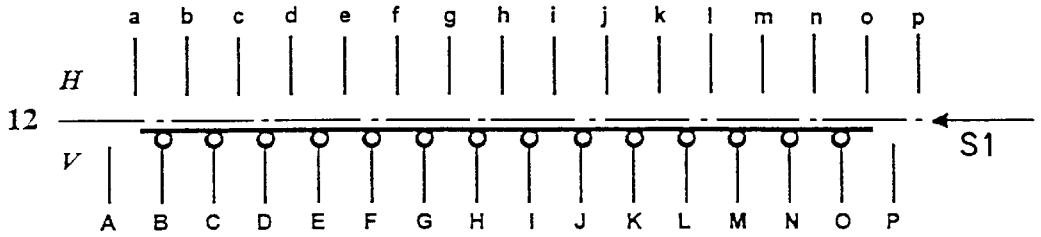
FIG.8.3C
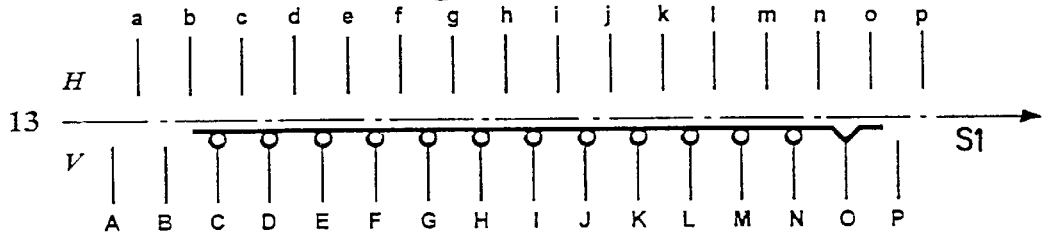
FIG.8.3D
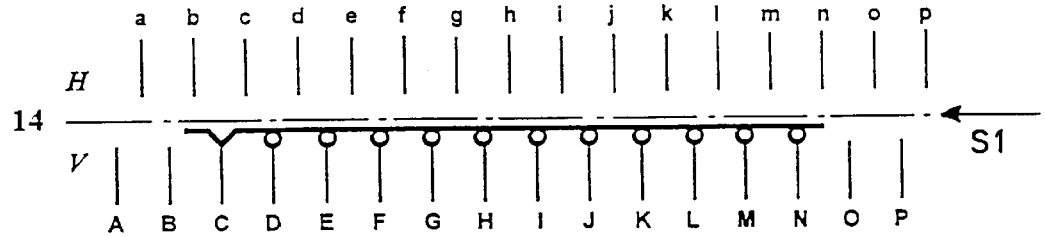
FIG.8.3E
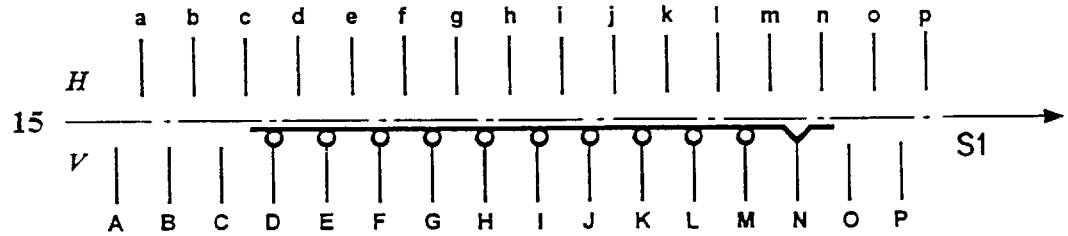

FIG.8.4A
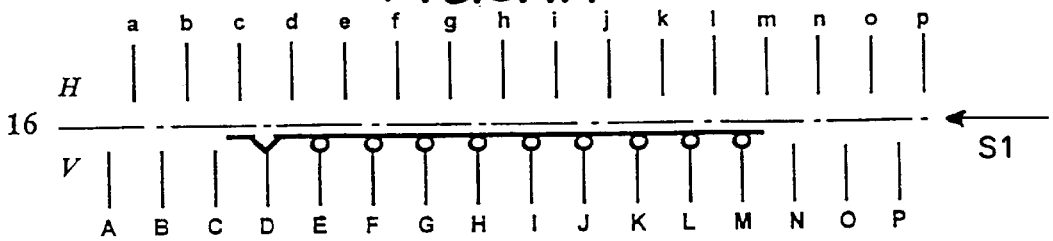
FIG.8.4B
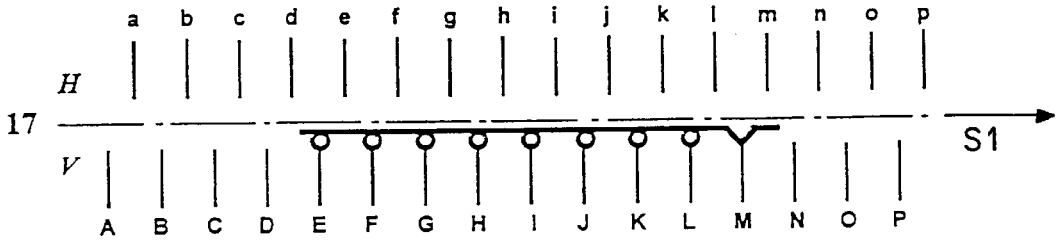
FIG.8.4C
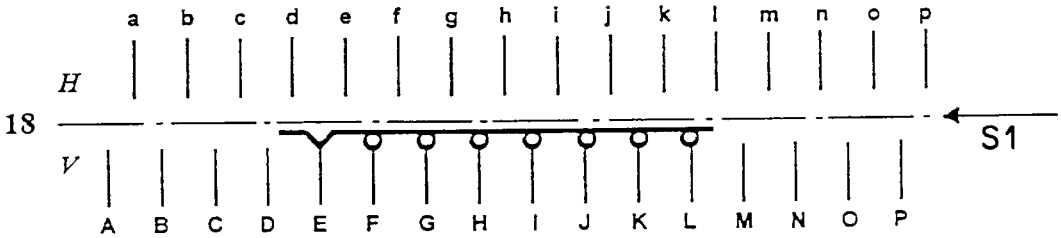
FIG.8.4D
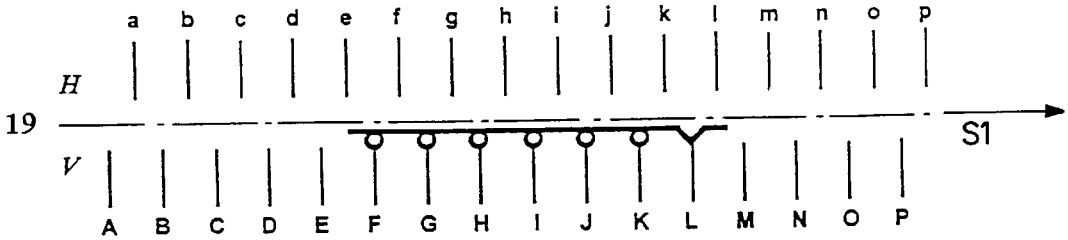
FIG.8.4E
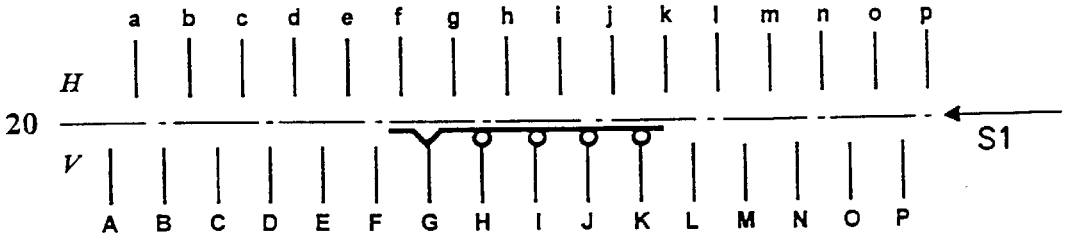

FIG.8.5A
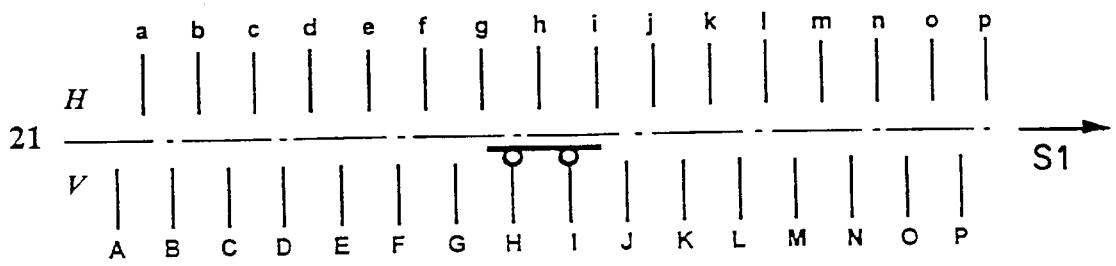
FIG.8.5B
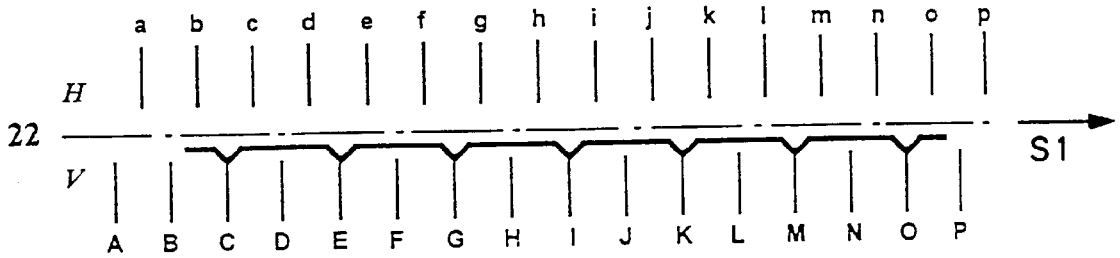

METHOD OF PRODUCING A KNITTED ARTICLE ON A FLAT KNITTING MACHINE

BACKGROUND OF THE INVENTION

The present invention relates to a method of producing a knitted article on a flat knitting machine.

For a rational manufacture of knitted articles, in particular in clothing industry, it is today required to provide as many manufacturing steps as possible on a knitting machine, so that only a few subsequent steps or no steps at all are needed. In the case of articles of clothing with fasteners, only a knitting of button holes on the knitting machine was performed. By means of a widening technique approximately round button holes can be produced. Longitudinal slot-shaped button holes can be formed by intarsia technique and horizontal slot shaped button holes can be performed by a looping technique. The buttons which correspond to the button holes must be sewn however in an additional working step. It has been recognized that the button which must be placed at the same height as the associated button hole requires a corresponding attention and therefore can be performed in a machine to a very limited extent.

On the other hand, fasteners on clothing articles are frequently needed, for example in form of buttons or button hole strips on cardigans, on reverse sides of a pullover, or on hand cuffs or pocket slots.

SUMMARY OF THE INVENTION

Accordingly, it is an object of the present invention to provide a method for producing knitted articles and a knitted article produced by it, which do not need or need only a few subsequent steps.

In keeping with these objects and with others which will become apparent hereinafter, one feature resides, briefly stated in a method of producing a knitted article on a flat knitting machine with at least two needle beds, wherein the knitted article has at least one button-shaped stitch structure as a fastener element, and the at least one button-shaped knitted structure is transformed by a local stitch aggregation into several successive knitting rows. With this button-shaped stitch structures, corresponding button holes which can be formed for example round, can be made by known widening technique.

For forming the button-shaped stitch structure, the following steps preferably can be performed:

A. Forming of stitches for a button-shaped stitch structure on one needle bed and forming tuck loops on the opposite needles of the other needle bed;

B. In both next knitting rows, forming of stitches for the button-shaped stitch structure and of tuck loops for left and right edge stitches of the button-shaped stitch structure, which have no connection to a basic knitted article;

C. Subsequently, forming of knitting rows with stitches and tuck loops in an alternating order, until the button-shaped stitch structure reaches a desired size;

D. Forming a knitting row with stitch formation on both needle beds;

E. Hanging the left edge stitch to a stitch of the basic knitted article;

F. Repeating the steps D and E for the right edge stitch;

G. Knitting a safety knitting row.

The present invention deals also with a second method of producing a knitted article on a flat knitting machine with at least two needle beds, wherein the knitted article has at least one stitch structure as a fastening element serving as a sleeve for an insertable solid body, and at least one stitch structure produced by a wedge shaping technique and closeable by a knitted-in knot thread. For producing this stitch sleeve the following steps can be preferably performed:

A. Insertion of a knot thread by means of a tuck loop in each second needle of a needle bed over a needle region whose width corresponds to the maximum diameter of the stitch structure;

B. Forming a short starting row for the stitch structure and connecting this stitch row with the knitted article by means of a tuck loop;

C. Forming further stitch rows for the stitch structure and connecting with the knitted article via a tuck loop, wherein the stitch structure is progressively alternatingly expanded at both sides until its maximum diameter is reached;

D. Forming at least two stitch rows, wherein correspondingly the edge stitch is not knitted off;

E. Forming stitch rows with progressive alternating-side reduction of the stitch number and connecting the stitch rows with the knitted article by tuck loops;

F. Inserting the warp thread by means of tuck loops in each second needle of the other needle bed over a needle region which corresponds to the maximum diameter of the stitch structure so that the knot threads are laid U-shaped around the stitch structure.

In this sleeve, subsequently a solid body can inserted, for example a button, and the sleeves are then closed by contraction and knotting of the knot thread. This type of the fastener element can also cooperate with various button holes. Instead of the button holes, loop-shaped fastener elements can be provided.

The invention also deals with a method for producing a knitted article on a flat knitting machine with at least two needle beds, wherein the knitted article has at least one loop-shaped stitch structure as a fastener element, which is formed by a small knitted strip connected at both ends with the knitted article. This fastener element can serve however not only for the receipt of the button-shaped stitch structure or the enveloped solid body or also conventional button, but also can be provided for example with tongues and cooperate with other loop-shaped fastener elements. The loop-shaped stitch structure can be formed for example by knitting only with each second needle, wherein the knitting and knot knitting needles alternate in each stitch row.

In addition to the above described methods, the present invention also deals with a knitted article which is produced by these methods.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5*a* is a view showing the section along the line A—A through the knitted article of FIG. 5*b;*

FIG. 5*b* is a view showing a detailed view of a knitted article with a fifth fastener type;

FIG. 5*c* is a view showing a section through the closed knitted article of FIG. 5*b;*

FIG. 6 is a view showing a stitch course for producing a fastener element in accordance with FIGS. 1 and 2;

FIG. 8 is a view a showing a loop course for producing a sleeve-shaped fastener element in accordance with FIGS. 3 and 4.

DESCRIPTION OF PREFERRED EMBODIMENTS

Figure 1B:
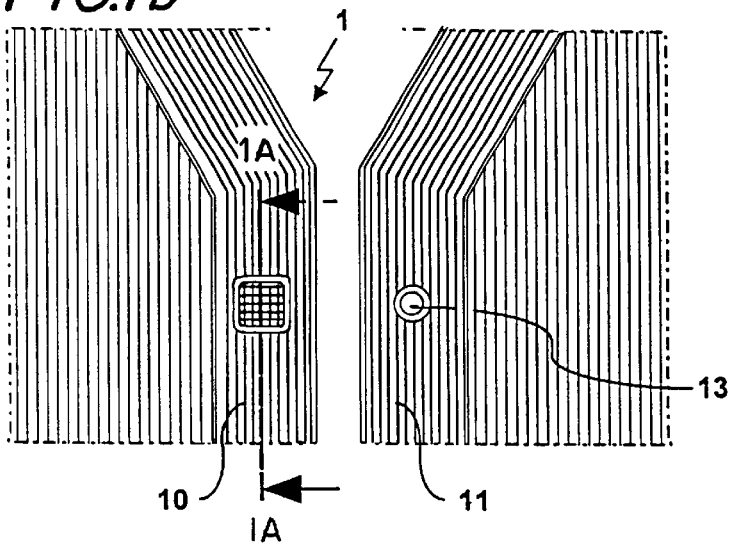
FIG. 1*b* is a partial view of a knitted article with a first fastener type in accordance with the present invention.
Figure 1A:
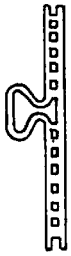
FIG. 1*a* is a view showing a section taken along the line A—A through a knitted article of FIG. 1*b;*
Figure 1C:
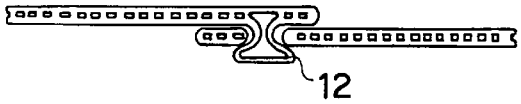
FIG. 1*c* is a view showing a cross-section through the closed knitted article of FIG. 1*b;*

FIG. 1*b* shows a detailed view of a jacket 1 with a button strip 10 and a button hole strip 11. Instead of the subsequently sewn buttons, button-shaped stitch structures 12 are knitted on the button strip 10, which together with a round shaped button hole 13 form a fastener of the knitted article 1. The spacial contour of the button-shaped stitch structure 12 is recognizeable in particular from the sectional views of FIGS. 1*a* and 1*c*.

Figure 2B:
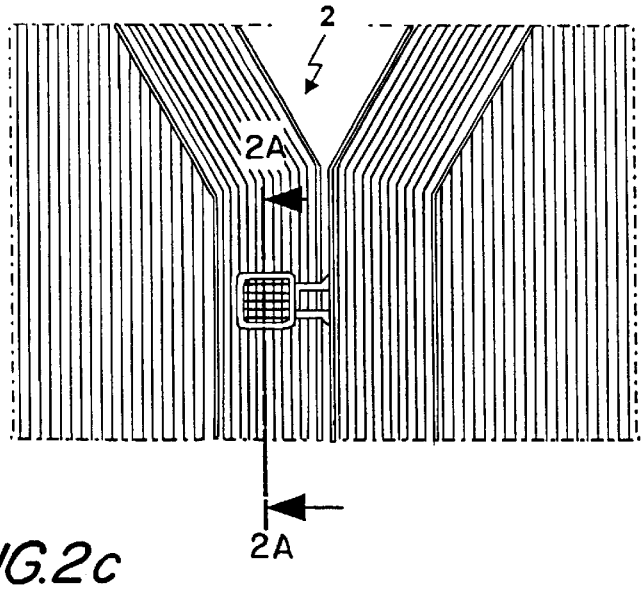
FIG. 2*b* is a detailed view of a knitted article with a second fastener type.
Figure 2A:
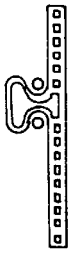
FIG. 2*a* is a view showing a section taken along the line A—A through the knitted article of FIG. 2*b;*
Figure 2C:
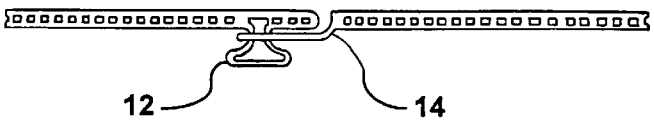
FIG. 2*c* is a view showing a cross-section through the closed knitted article of FIG. 2*b;*

FIG. 2 shows the same fastener element 12 which cooperates here however with a loop-shaped fastener element 14. The edges of the knitted article 2 are not located here over one another as in the knitted article of FIG. 1, but instead are located near one another when the fasteners 12, 14 are connected (FIG. 2*c*). It is however also possible with this fastener technique to form overlapping knitted article edges.

Figure 3B:
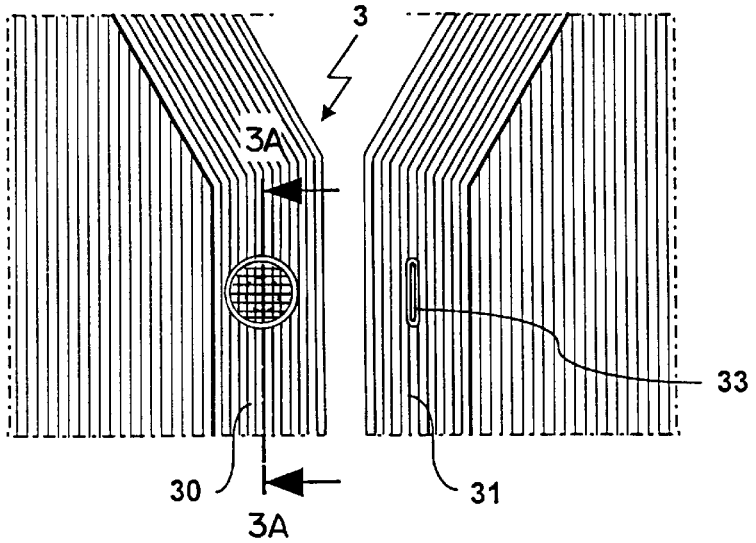
FIG. 3*b* is a detailed view of a knitted article with a third fastener type.
Figure 3A:
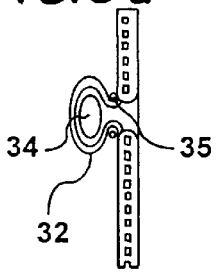
FIG. 3*a* is a view showing a section taken along the line A—A through the knitted article of FIG. 3*b;*
Figure 3C:
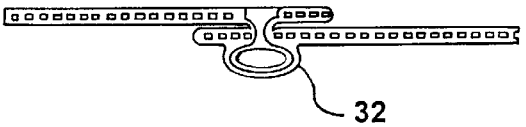
FIG. 3*c* is a view showing a cross-section through the closed knitted article of FIG. 3*b;*
Figure 4B:
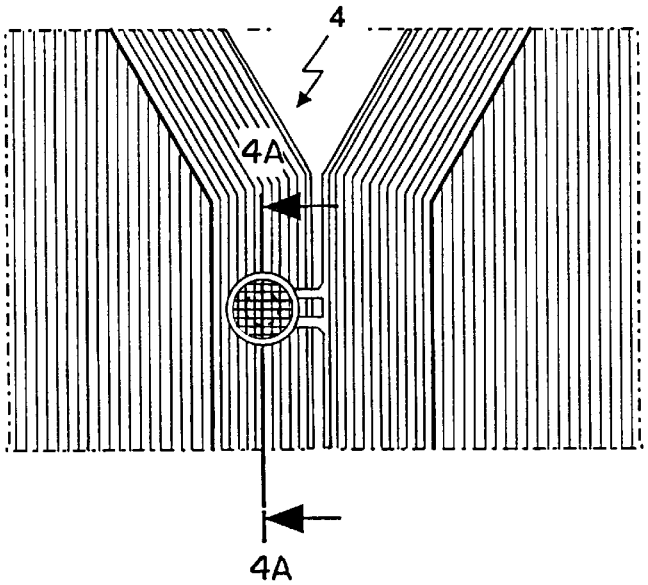
FIG. 4*b* is a detailed view of a knitted article with a fourth fastener type.
Figure 4A:
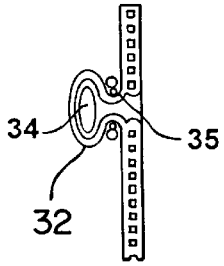
FIG. 4*a* is a view showing the section along the line A—A through the knitted article of FIG. 4*b;*
Figure 4C:
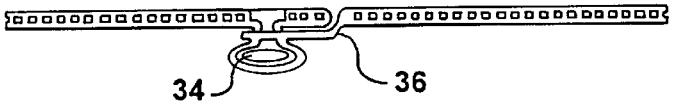
FIG. 4*c* is a view showing a cross-section through the closed knitted article of FIG. 4*b;*
Figure 7A:
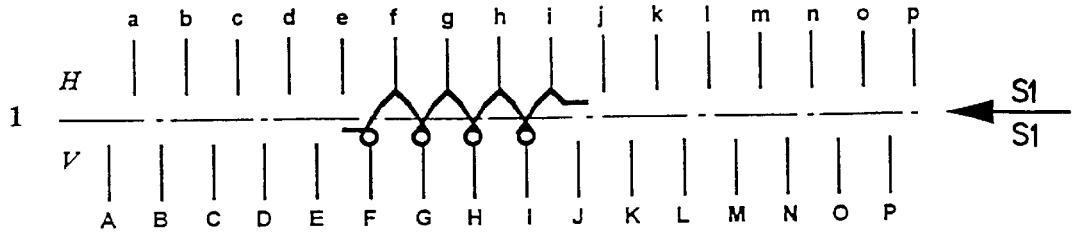
FIG. 7 is a view showing a stitch course for producing a loop-shaped fastener element in accordance with FIGS. 2, 4, 5.
Figure 7B:
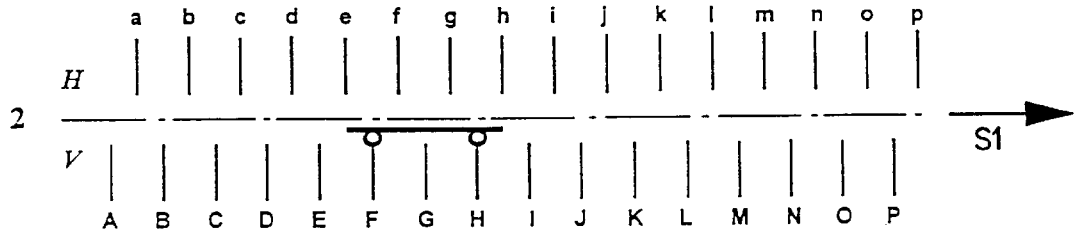
Figure 7C:
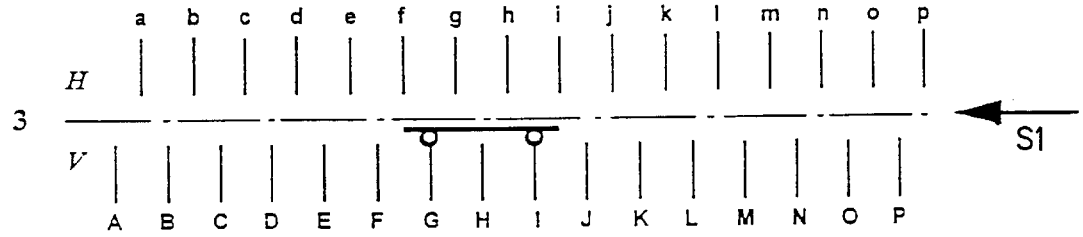
Figure 7D:
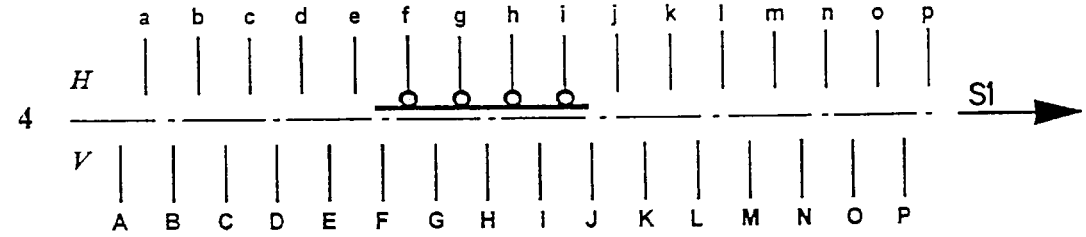
Figure 7E:
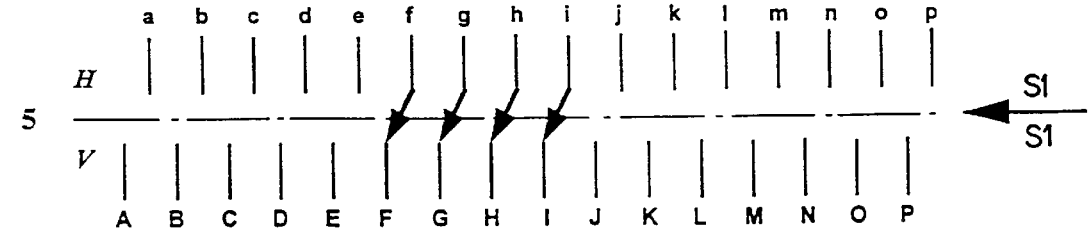

FIG. 3 shows a knitted article 3 in form of a vest which has a button strip 30 and a button hole strip 31. Slot-shaped button holes which extend in a longitudinal direction are formed in the button hole strips 31 by a known intarsia technique. Fastener elements 32 in form of a sleeve for a solid body 34 (FIGS. 3*a*, 3*c*) are knitted on the button strip 30. The solid body 34 can be inserted subsequently into the knitted sleeve 32 and then the sleeve 32 is closed by a knot thread 35 (FIG. 3*a*). FIG. 4 shows a knitted article 4 in which the sleeve-shaped fastener element 32 cooperates with a loop-shaped fastener element 36.

A further alternative of a fastening is shown in the knitted article 5 in FIG. 5. Both fastener elements 50, 51 are composed of loop-shaped stitch structures. The stitch structure 50 is shorter and therefore wider, and serves for receiving a tongue 52. The second loop 51 is thinner and longer, and is located for fastening of the knitted article 5 over the tongue 52.

All fastening types shown in FIGS. 1–5 can be produced completely or at least substantially on the knitting machine, so that the required subsequent clothing works on the knitted article can be reduced to minimum. In accordance with FIGS. 6–8 preferable manufacturing processes for producing the illustrated, new fastening elements are represented.

FIG. 6 shows the production of the fastener element 2 of FIGS. 1 and 2. A start row for the stitch structure 12 is formed on the front needle bed V through four needles, in row 1 in the knitting direction from right to left with a first knitting system S1. The connection for the rear needle bed H is produced by tuck loops on the opposite needles. In row 2, in knitting direction from left to right, with the first system S1 and the needles F and H of the front needle bed V stitches are produced, and with the needles D a tuck loop for the stitch structure 12 is produced. The tuck loop on the needle D has no connection to the basic knitted article, whereby the left edge of the fastener element 12 produced by a stitch aggregation is round. Row 3 shows the mirror-symmetrical production of a stitch row in knitting direction from right to left, wherein with the needles E and G stitches are formed and with the needle I a tuck loop is formed for an edge stitch which is not connected with the basic knitting article.

In row 5 a further stitch row follows, whereby only each second needle D, F, H knits, while on the opposite needles E and G tuck loops are produced. In row 5, in the opposite knitting direction, the production of a further row with alternating stitches and tuck loops is performed, wherein however the needles E, G, and I form stitches and the needles F and H form tuck loops. The rows 4 and 5 are repeated until the stitch structure 12 reaches the desired size. By the alternating knitting of stitches and tuck loops in each knitting row, a voluminous but firm structure is produced. In row 6, subsequently with the first knitting system S1 in the knitting direction from left to the right, stitches for the stitch structure 12 are formed on the front needle bed W, and with the needles e and g in the rear needle bed H they are bound in. Subsequently, in the row 7 the hanging of the edge stitches D which are not connected with the basic knitting article to the stitches on the needles e of the rear needle bed H is performed. In row 8 the carriage is moved on that knitting article side, at which the thread guide is located, before in row 9 again a stitch row is knitted on the front needle bed V with simultaneous binding-in in the rear needle bed H. In row 10 then the right edge stitch is hang from the needle I to the stitch on the needle h of the rear needle bed H. After a new empty row 11, in row 12 a safety knitting row is knitted on the bound-in stitch structure.

FIG. 7 illustrates a possible manufacturing process for a loop-shaped fastener element, such as for example the fastener elements 14, 36, 50, 51. In row I in the knitting direction from right to left with the first knitting system S1, a starting row for the loop-shaped stitch structure is formed on the front needle bed V over four needles. By tuck loops on the opposite needles of the rear needle bed H a connection to the rear needle bed is produced. In row 2 with each second needle F and H, a stitch row for the loop is formed. Subsequently in row 3 in the opposite carriage direction, a further stitch row is formed with each second needle for the loop, whereby however those needle knit which do not knit in the row 2. The rows 2 and 3 are repeated until the loop reaches the desired length. Subsequently in row 4 the needles of the rear needle bed H are knitted off, before in the row 5 with the first knitting system S1 the stitches of the rear needle bed H hang on the front needle bed V and thereby the loop is closed.

FIG. 8 illustrates the production of a sleeve-shaped stitch structure for a solid body 34, as shown in FIGS. 3 and 4. First in row 1 with a first thread guide in a needle region which corresponds to the maximum diameter with the stitch structure 32, a knot thread is inserted by means of tuck loops into each second needle of the front needle bed V. Then with a second thread guide in row 2, the formation of a starting row of the stitch structure 32 is performed. This stitch row is bound with tuck loop on the needle G at the left side into the knitted article. In row 3 with the second thread guide, the stitch structure is expanded around two needles to the right. With a tuck loop on the needle M, the binding in of the stitch row into the knitted article at the right side is performed again. In row 4, in the opposite knitting direction, a further stitch row is formed on the front needle bed V, wherein the stitch structure 32 at the left side is broadened by two stitches and is bound by means of the tuck loop on the needle E into the basic knitted article.

In the rows 5–9 the stitch structure is widened to the right in the same way as in row 3, by one stitch correspondingly. In the knitting rows 6, 8 and 10 a widening of the stitch structure 32 by one stitch is performed at the left side, in the same way as in the row 4. Subsequently, in rows 11 and 12, stitch rows are knitted over the full width of the stitch structure 32, wherein however the edge needles B and P are not stitched, whereby the edge is rounded. The rows 11 and 12, depending on desired contour of the stitch structure, are repeated one or many times. In the stitching rows 13, 15, 17 and 19 subsequently the stitch structure is reduced at the left side and in the stitching rows 14, 16, 18 and 20 is reduced at the left side, until in row 21 a knitting width of two stitches remains. Subsequently, the knot thread is inserted with the thread guide 1 by means of a tuck loop into each second needle of the front needle bed V, so that it is laid U-shaped around the stitch structure 32. In a subsequent clothing-making step, solid bodies 34 are each inserted in the stitch structure 32. Subsequently, the both ends of the knot thread 35 at the right end of the stitch structure 32 are contracted and knotted. Thereby a button-like fastener element is produced without a sewing process.

It will be understood that each of the elements described above, or two or more together, may also find a useful application in other types of methods differing from the types described above.

While the invention has been illustrated and described as embodied in method of producing a knitted article on a flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing a knitted article on a flat knitting machine with at lest two needle beds, comprising the steps of providing a knitted article with at least one button-shaped knitted stitch structure as a fastener; and converting the at least one button-shaped stitch structure into several successive knitting rows by knitting with a local stitch aggregation; and performing the following steps for forming the button-shaped stitch structure:

a. Forming of stitches for the button-shaped stitch structure on one needle bed and forming of tuck loops on opposite needles of the other needle bed;

b. In both next knitting rows, forming of stitches for the button-shaped stitch structure and of tuck loops for left and right edge stitches of the button-shaped stitch structure, which have no connections to a basic knitted article;

c. Thereafter forming of knitting rows with stitches and tuck loops in alternating order, until the button-shaped stitch structure reaches a desired size;

d. Forming a knitting row with stitch formation on both needle beds;

e. Hanging left edge stitches to a stitch of the basic knitted article;

f. Repeating the two preceding steps for the right edge stitches; and g. Knitting a safety knitting row.

2. A method of producing a knitting article on a flat knitting machine with at least two needle beds, comprising a knitted article with at least one knitted stitch structure as a fastener element serving as a sleeve for an insertable solid body; producing the at least one stitch structure by knitting with a wedge shaping technique; and closing with a knitted-in knot thread; and performing the following steps for producing the stitch structure;

a. Inserting a knot thread by tuck loops in each second needle of one needle bed over a needle region which corresponds to a maximum diameter of the stitch structure;

b. Forming a short starting row for the stitch structure and connecting this stitch row with a basic knitted article by means of a tuck loop;

c. Forming further stitch rows for the stitch structure and connecting with the knitted article through a tuck loop, wherein the stitch structure continuously is expanded alternatingly at both sides until its maximum diameter is reached;

d. Forming at least two stitch rows wherein each edge stitch is not knitted;

e. Forming of stitch rows with continuously alternatingly reducing a number of stitches and binding the stitch rows with the knitted article by tuck loops; and f. Inserting the knot thread by means of tuck loops in each second needle of the one needle bed over a needle region which corresponds to a maximum diameter of the stitch structure.

3. A method of producing a knitted article on a flat knitting machine with at least two needle beds, comprising the steps of providing a knitted article with at least one button-shaped knitted stitch structure as a fastener; and converting the at least one button-shaped stitch structure into several successive knitting rows by knitting with a local stitch aggregation.

4. A method of producing a knitting article on a flat knitting machine with at least two needle beds, comprising the steps of providing a knitted article with at least one knitted stitch structure as a fastener element serving as a sleeve for an insertable solid body; producing the at least one stitch structure by knitting with a wedge shaping technique; and closing with a knitted-in knot thread.

5. A method of producing a knitted article on a flat knitting machine with at least two needle beds, comprising the steps of providing a knitted article with at least one loop-shaped knitted stitch structure as a fastener; and forming the same by knitting with a small knitting strip connected at both ends with the knitted article.

6. A method as defined in claim 5; and further comprising forming stitch rows of the loop-shaped stitch structure by knitting only each second needle, wherein knitting and not knitting needles alternate in each stitch row.

7. A method as defined in claim 5; and further comprising inserting a gag in at least one loop-shaped stitch structure.

8. A knitted article produced by the method including the steps of providing a knitted article with at least one knitted button-shaped stitch structure as a fastener and converting the at least one button-shaped stitch structure into several successive knitting rows by knitting with a local stitch aggregation.

9. A knitted article produced by the method including the steps of providing a knitted article with at least one knitted stitch structure as a fastener element serving as a sleeve for an insertable solid body; providing at least one stitch structure by knitting with a larding technique, and closing with a knitted-in knot thread.

10. A knitted article produced by the method including the steps of providing a knitted article with at least one knitted loop-shaped stitch structure as a fastener, and forming the same by knitting with a small knitting strip connected at both ends with the knitted article.

* * * * *